US010040170B2

(12) United States Patent
Bechthold

(10) Patent No.: US 10,040,170 B2
(45) Date of Patent: Aug. 7, 2018

(54) ROTARY SANDING SYSTEM

(71) Applicant: Perry D. Bechthold, Palmer, MA (US)

(72) Inventor: Perry D. Bechthold, Palmer, MA (US)

( * ) Notice: Subject to any disclaimer, the term of this patent is extended or adjusted under 35 U.S.C. 154(b) by 140 days.

(21) Appl. No.: 15/058,983

(22) Filed: Mar. 2, 2016

(65) Prior Publication Data

US 2017/0252899 A1 Sep. 7, 2017

(51) Int. Cl.

*B24B 23/02* (2006.01)
*B24D 9/08* (2006.01)
*B24B 55/10* (2006.01)

(52) U.S. Cl.

CPC ..... *B24D 9/08* (2013.01); *B24B 23/02* (2013.01); *B24B 55/102* (2013.01)

(58) Field of Classification Search

CPC ..... B24B 23/02; B24B 23/022; B24B 23/026; B24B 45/00; B24B 45/003; B24B 45/006; B24B 55/052; B24D 9/08

See application file for complete search history.

(56) References Cited

U.S. PATENT DOCUMENTS 2,802,316 A 8/1957 Block
3,623,281 A * 11/1971 Moffat ..... B24B 45/006 451/509
4,932,163 A * 6/1990 Chilton ..... B24B 55/102 451/359
5,201,149 A 4/1993 Eisenblatter
5,713,785 A * 2/1998 Nishio ..... B24B 55/052 125/9
5,725,423 A 3/1998 Barry et al.
6,116,996 A * 9/2000 Yanase ..... B24B 23/02 451/359
6,371,837 B1 * 4/2002 Luedeke ..... B24B 45/006 451/342
6,743,086 B2 6/2004 Nelson et al.
6,758,732 B1 * 7/2004 Hilton ..... B24B 23/028 451/177
D633,928 S 3/2011 Nilsson et al.
7,988,533 B2 8/2011 Thomas et al.
D679,299 S * 4/2013 Greiderer ..... D15/126
D687,471 S 8/2013 Fu et al.
2002/0031992 A1 * 3/2002 Clowers ..... B24B 23/03 451/357
2003/0096566 A1 * 5/2003 Fritz ..... B24B 23/02 451/508
2005/0037701 A1 * 2/2005 Steimel ..... B24B 45/006 451/359
2014/0011433 A1 * 1/2014 Marton ..... B24B 45/003 451/456
2015/0251295 A1 * 9/2015 Chen ..... B24B 45/006 451/509

FOREIGN PATENT DOCUMENTS

WO WO2012030293 3/2012

* cited by examiner

*Primary Examiner* — Timothy V Eley

(57) ABSTRACT

A rotary sanding system for retro fitting a Rotozip sanding disk to an air tool includes a first disk that may be removably coupled to an air tool thereby facilitating the air tool to rotate the first disk. The first disk has a plurality of openings extending therethrough and air may pass through the openings. A mating unit is coupled to the first disk. The mating unit engages the air tool thereby facilitating the first disk to be removably coupled to the air tool. A sanding disk is removably coupled to the first disk. The sanding disk may abrade a surface when the air tool rotates the first disk.

8 Claims, 5 Drawing Sheets

ROTARY SANDING SYSTEM

BACKGROUND OF THE DISCLOSURE

Field of the Disclosure

The disclosure relates to sanding devices and more particularly pertains to a new sanding device for retro fitting a Rotozip sanding disk to an air tool.

SUMMARY OF THE DISCLOSURE

An embodiment of the disclosure meets the needs presented above by generally comprising a first disk that may be removably coupled to an air tool thereby facilitating the air tool to rotate the first disk. The first disk has a plurality of openings extending therethrough and air may pass through the openings. A mating unit is coupled to the first disk. The mating unit engages the air tool thereby facilitating the first disk to be removably coupled to the air tool. A sanding disk is removably coupled to the first disk. The sanding disk may abrade a surface when the air tool rotates the first disk.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
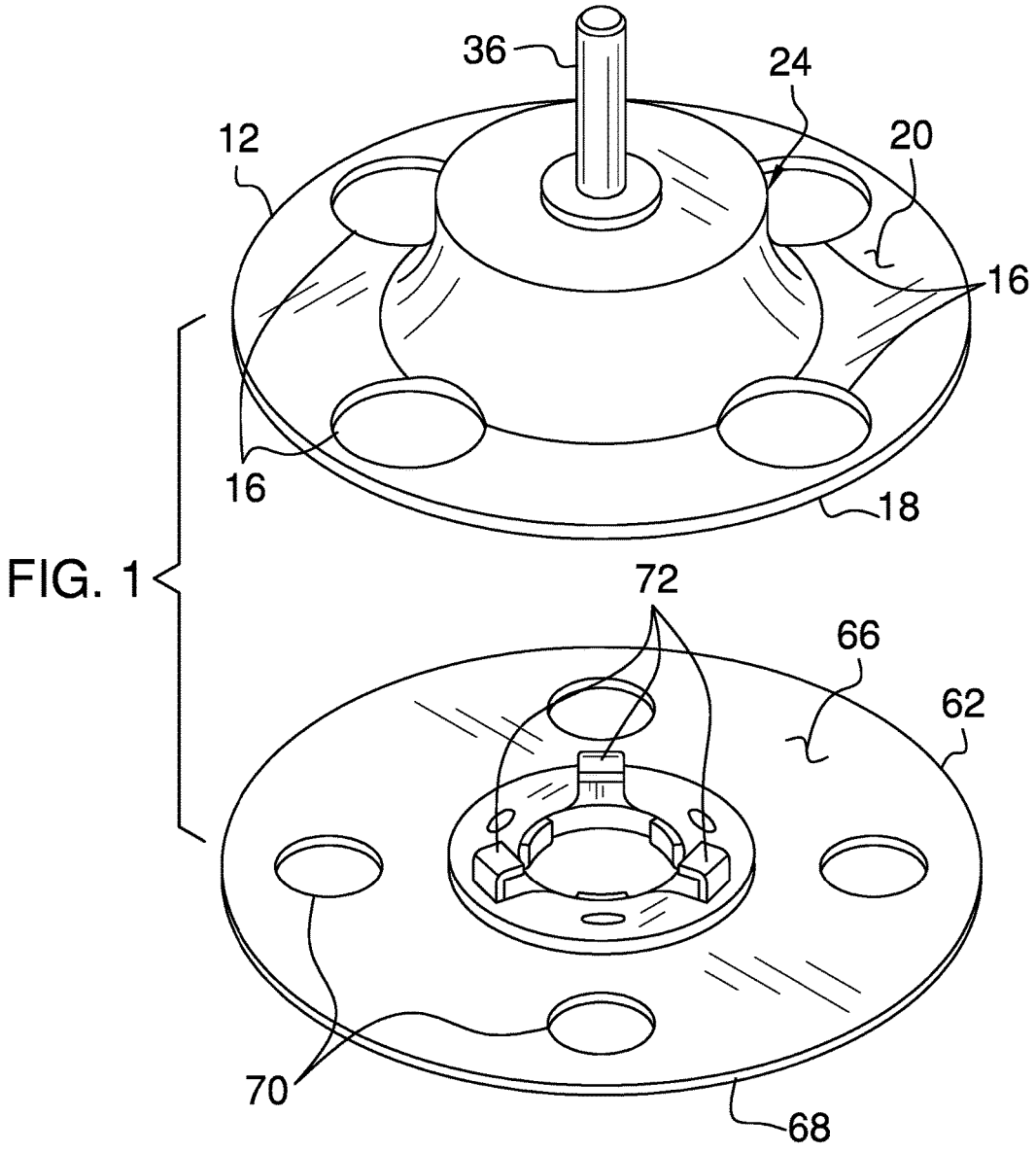
FIG. 1 is an exploded perspective view of a rotary sanding system according to an embodiment of the disclosure.
Figure 2:
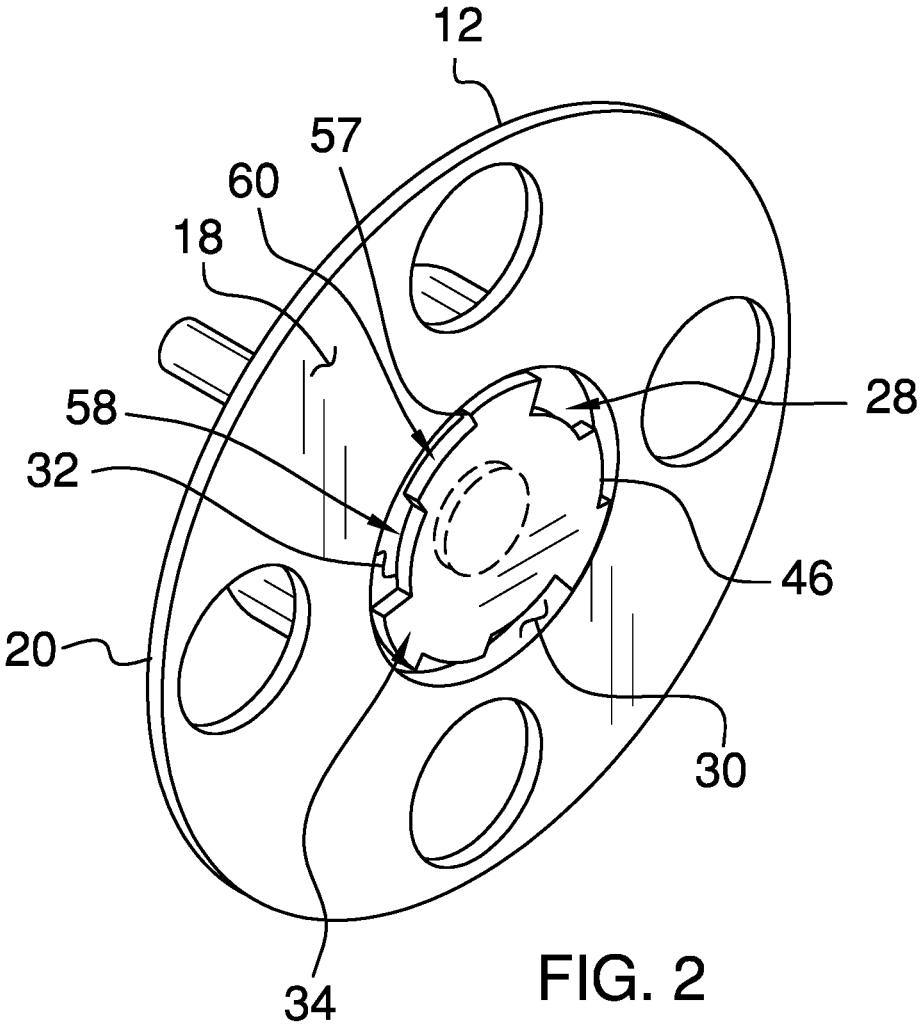
FIG. 2 is a bottom perspective view of an embodiment of the disclosure.
Figure 3:
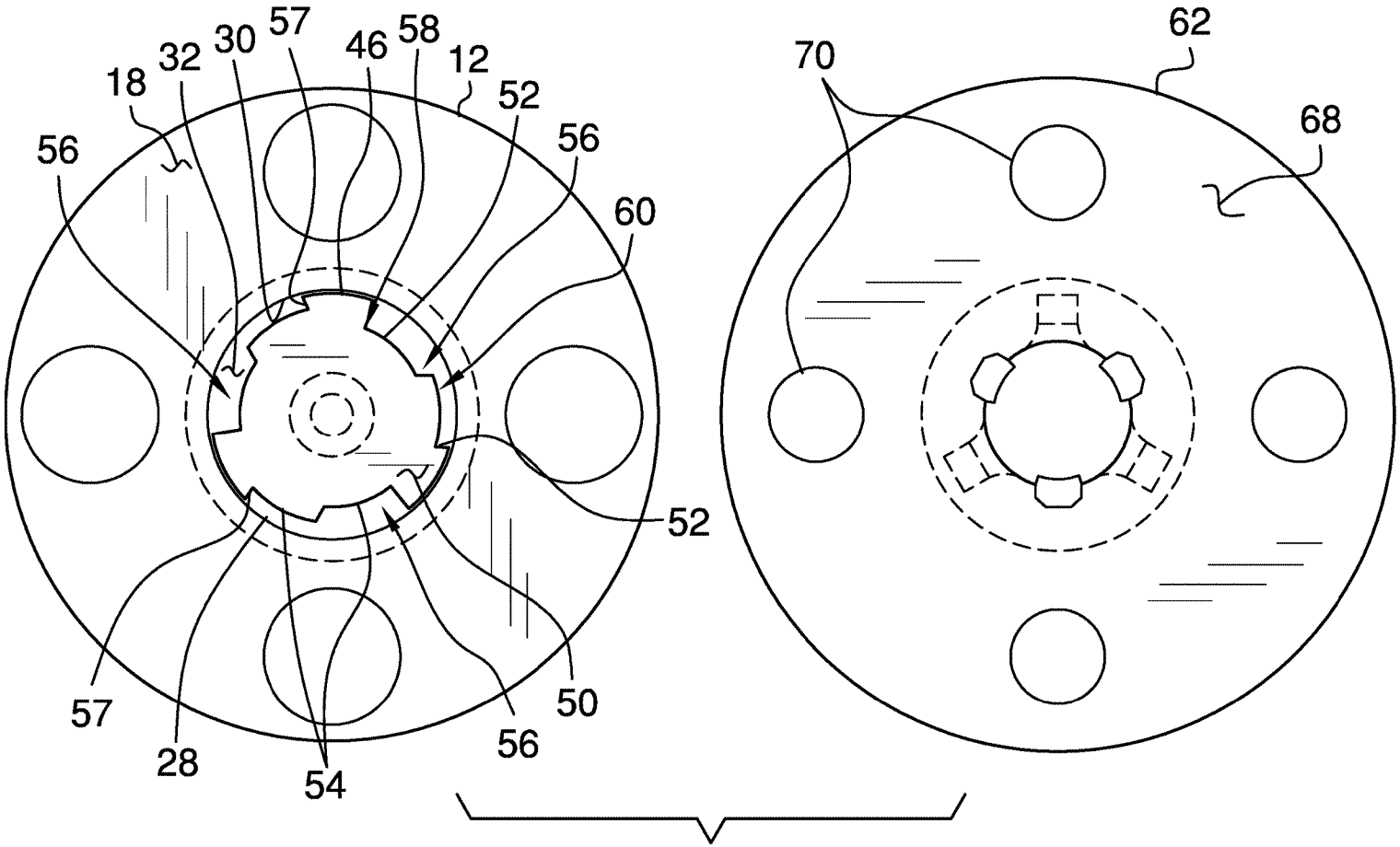
FIG. 3 is a bottom view of an embodiment of the disclosure.
Figure 4:
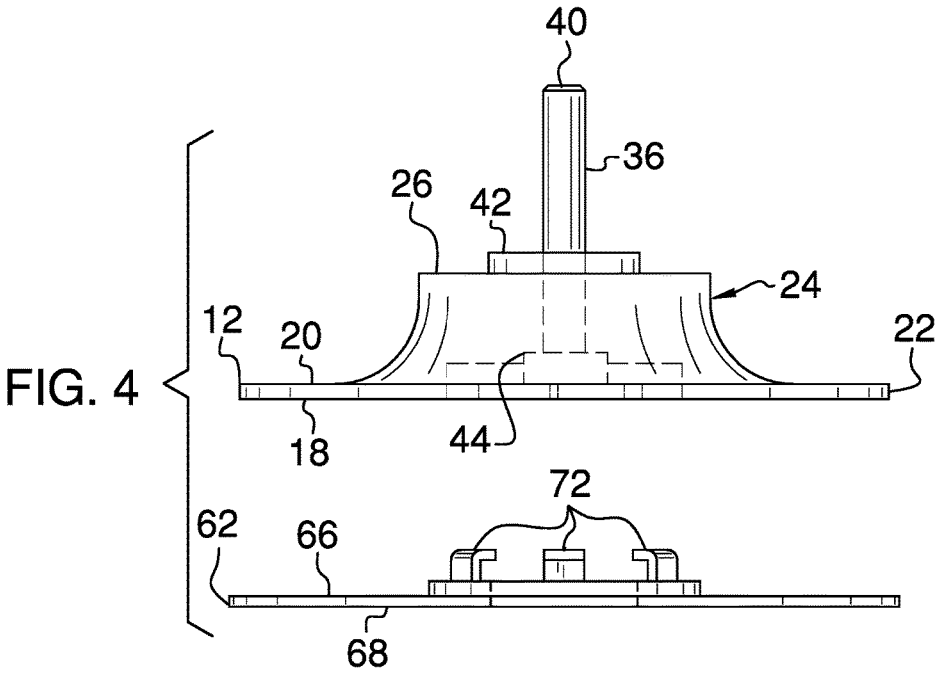
FIG. 4 is a front view of an embodiment of the disclosure.
Figure 5:
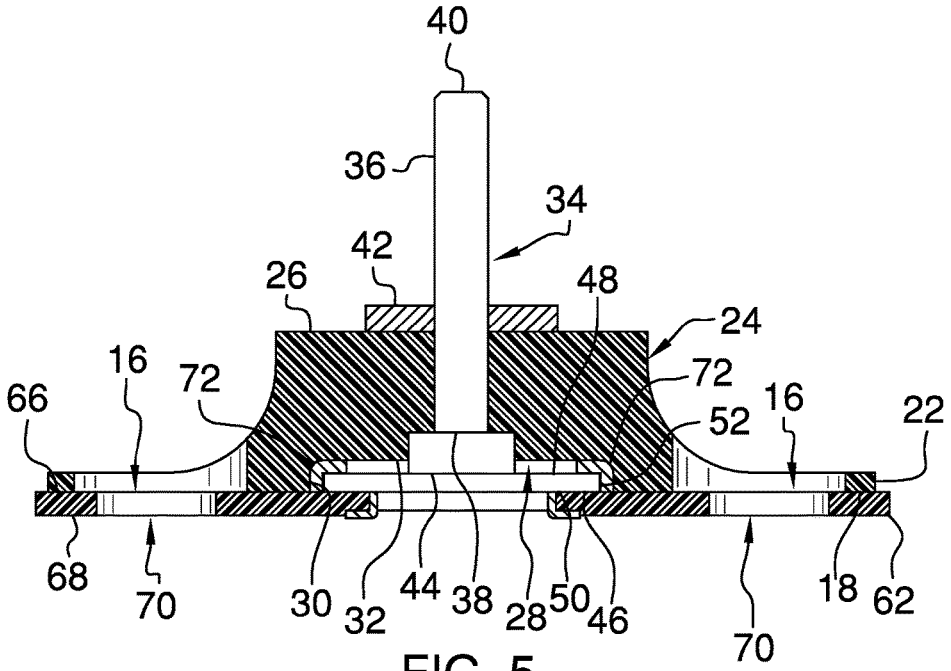
FIG. 5 is a front side cut away view of an embodiment of the disclosure.
Figure 6:
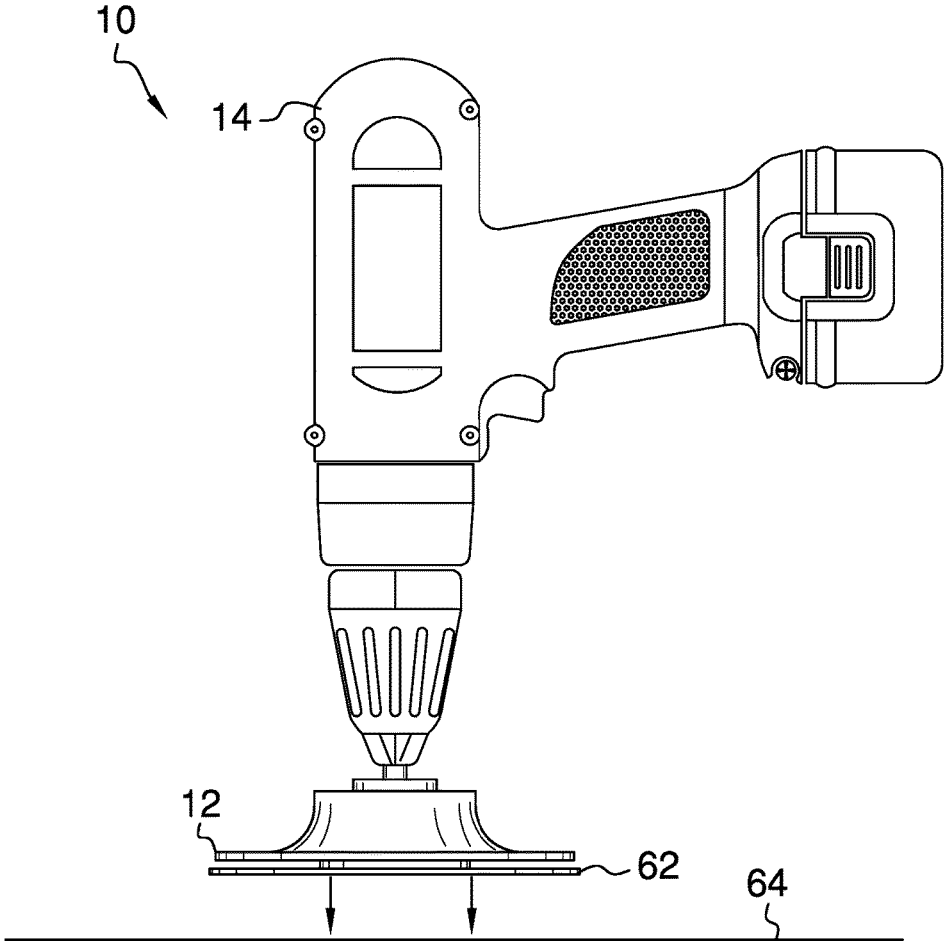
FIG. 6 is a perspective in-use view of an embodiment of the disclosure.

With reference now to the drawings, and in particular to FIGS. 1 through 6 thereof, a new sanding device embodying the principles and concepts of an embodiment of the disclosure and generally designated by the reference numeral 10 will be described.

As best illustrated in FIGS. 1 through 6, the rotary sanding system 10 generally comprises a first disk 12 that may be removably coupled to an air tool 14. Thus, the air tool 14 may rotate the first disk 12. The air tool 14 may comprise a Roto-Zip or the like. The air tool 14 may have a rotational speed ranging between approximately ten thousand rpm and twenty thousand rpm. The first disk 12 has a plurality of openings 16 extending therethrough and air may pass through the openings 16.

The first disk 12 has a bottom surface 18, a top surface 20 and a peripheral edge 22 extending between the top surface 20 and the bottom surface 18. The top surface 20 curves upwardly from the bottom surface 18 to define a prominence 24 on the first disk 12. The prominence 24 is centrally positioned on the first disk 12 and the prominence 24 has a top end 26. The first disk 12 may have a height ranging between one cm and four cm. The first disk 12 may have a diameter ranging between approximately seven cm and twelve cm.

The bottom surface 18 has a well 28 extending toward the top surface 20. The well 28 has a lateral bounding surface 30 and a bottom bounding surface 32. The lateral bounding surface 30 is continuous such that the well 28 has a circular shape. The well 28 is centrally positioned on the bottom surface 18. The well 28 may have a depth ranging between approximately three mm and seven mm. Each of the openings 16 is positioned between the prominence 24 and the peripheral edge 22. The openings 16 are spaced apart from each other and distributed around the first disk 12.

A mating unit 34 is coupled to the first disk 12 and the mating unit 34 may engage the air tool 14. Thus, the first disk 12 is removably coupled to the air tool 14. The mating unit 34 comprises a shaft 36 that has a lower end 38 and an upper end 40. The shaft 36 may have a length ranging between approximately four cm and seven cm.

The shaft 36 extends through the prominence 24 and the bottom surface 18. The upper end 40 is spaced from the top end 26 of the prominence 24. The shaft 36 is centrally positioned on the first disk 12 such that the lower end 38 is positioned in the well 28. The shaft 36 may engage the air tool 14.

A first washer 42 is coupled around the shaft 36. The first washer 42 abuts the top end 26 of the prominence 24 such that the shaft 36 is inhibited from sliding downwardly in the first disk 12. A second washer 44 is coupled around the shaft 36. The second washer 44 abuts the bottom bounding surface 32 of the well 28 such that the shaft 36 is inhibited from sliding upwardly in the first disk 12.

A lock 46 is provided. The lock 46 has a first surface 48, a second surface 50 and an outer edge 52 extending between the first surface 48 and the second surface 50. The outer edge 52 is continuous such that the lock 46 has a circular shape. The first surface 48 is coupled the lower end 38 of the shaft 36. The second surface 50 is aligned with the bottom surface 18 of the first disk 12. The first surface 48 may be welded to the lower end 38 of the shaft 36.

The outer edge 52 of the lock 46 is coextensively spaced from the lateral bounding surface 30 of the well 28. The outer edge 52 has a plurality of cut away sections 54 and each of the cut away sections 54 extends inwardly toward a center 56 of the lock 46. Each of the cut away sections 54 forms an associated one of a plurality of keyways 56 with the lateral bounding surface 30. Each of the keyways 56 has a terminal end 57.

The keyways 56 are spaced apart from each other and distributed around the lock 46. Each of the keyways 56 has a first portion 58 and a second portion 60. The first portion 58 has a width that is greater than a width of the second portion 60. The terminal end 57 is located on the second portion 60.

A sanding disk 62 is provided. The sanding disk 62 is removably coupled to the first disk 12. The sanding disk 62 may abrade a grinding surface 64 when the air tool 14 rotates the first disk 12. The grinding surface 64 may comprise wood, metal, ceramic or any other grindable surface. The sanding disk 62 may be a Rotozip sanding disk manufactured by Robert Bosch Tool Corporation at 1800 W Central Rd, Mount Prospect, Ill., 60056, United States.

The sanding disk 62 has an upper surface 66 and a lower surface 68. The sanding disk 62 has a plurality of cooling holes 70 extending through the upper surface 66 and the lower surface 68. The sanding disk 62 has a plurality of hooks 72. Each of the hooks 72 is coupled to and extends away from the upper surface 66. The lower surface 68 is textured with a resilient material thereby facilitating the lower surface 68 to abrade the grinding surface 64.

Each of the hooks 72 is insertable into the first portion 58 of associated one of the keyways 56. The sanding disk 62 is rotated to position each of the hooks 72 in the second portion 60 of the associated keyway 56. Thus, the hooks 72 engage the first surface 48 of the lock 46 such that the sanding disk 62 is removably coupled to the first disk 12. The first disk 12 facilitates the Rotozip sanding disk to be retro-fitted onto the air tool.

The sanding disk 62 is rotated such that each of the hooks 72 engages the terminal end 57 corresponding to the associated keyway 56. Thus, the first disk 12 rotates the sanding disk 62 when the air tool 14 rotates the first disk 12. Each of the cooling holes 70 is aligned with an associated one of the openings 16. Thus, the openings 16 and the cooling holes 70 facilitate air to cool the grinding surface 64 when the sanding disk 62 abrades the grinding surface 64. Additionally, the grinding surface 64 is visible through the openings 16 and the cooling holes 70 while the sanding disk 62 abrades the grinding surface 64.

In use, the shaft 36 is coupled to the air tool 14 such that the air tool 14 rotates the first disk 12. The sanding disk 62 is manipulated to position each of the hooks 70 within the first portion 58 of the associated keyway 56. The sanding disk 62 is rotated such that each of the hooks 70 abuts the terminal end 57 of the associated keyway 56. Thus, the sanding disk 62 is removably coupled to the first disk 12 and the first disk 12 rotates the sanding disk 62. The grinding surface 64 is viewed through the openings 16 and the cooling holes 70 while the sanding disk 64 abrades the grinding surface 64.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A rotary sanding system comprising:

a first disk being configured to be removably coupled to an air tool thereby facilitating the air tool to rotate said first disk, said first disk having a plurality of openings extending therethrough wherein said openings are configured to have air pass through said openings, said first disk having a prominence, a bottom surface and a well;

a mating unit being coupled to said first disk wherein said mating unit is configured to engage the air tool thereby facilitating said first disk to be removably coupled to the air tool, said mating unit including a shaft having a lower end, said shaft extending through said prominence and said bottom surface, said shaft being centrally positioned on said first disk such that said lower end is positioned in said well, said shaft being configured to engage the air tool;

a lock having a first surface, a second surface and an outer edge extending between said first surface and said second surface, said outer edge being continuous such that said lock has a circular shape, said first surface being coupled to said lower end of said shaft having said second surface being aligned with said bottom surface of said first disk, said outer edge being coextensively spaced from a lateral bounding surface of said well; and a sanding disk being removably coupled to said first disk wherein said sanding disk is configured to abrade a surface when the air tool rotates said first disk.

2. The system according to claim 1, wherein said first disk has a bottom surface, a top surface and a peripheral edge extending between said top surface and said bottom surface, said top surface curving upwardly from said bottom surface to define a prominence on said first disk, said prominence being centrally positioned on said first disk, said prominence having a top end.

3. The system according to claim 2, wherein:

said bottom surface having a well extending toward said top surface, said well having a lateral bounding surface and a bottom bounding surface, said lateral bounding surface being continuous such that said well has a circular shape, said well being centrally positioned on said bottom surface; and each of said openings being positioned between said prominence and said peripheral edge, said openings being spaced apart from each other and distributed around said first disk.

4. The system according to claim 1, further comprising:

a first washer being coupled around said shaft, said first washer abutting a top end of said prominence such that said shaft is inhibited from sliding downwardly in said first disk; and a second washer being coupled around said shaft, said second washer abutting a bottom bounding surface of said well such that said shaft is inhibited from sliding upwardly in said first disk.

5. The system according to claim 1, wherein said outer edge has a plurality of cut away sections, each of said cut away sections extending inwardly toward a center of said lock, each of said cut away sections forming an associated one of a plurality of keyways with said lateral bounding surface, each of said keyways having a terminal end.

6. The system according to claim 1, wherein said sanding disk has an upper surface and a lower surface, said sanding disk having a plurality of cooling holes extending through said upper surface and said lower surface, said sanding disk having a plurality of hooks, each of said hooks being coupled to and extending away from said upper surface.

7. The system according to claim 6, wherein:

said first disk has a plurality of keyways and a plurality of openings, each of said keyways having a terminal end; and each of said hooks is insertable into an associated one of said keyways having each of said hooks engaging said lock such that said sanding disk is removably coupled to said first disk, said sanding disk being rotated such that each of said hooks engages said terminal end corresponding to said associated keyway such that said first disk rotates said sanding disk, each of said cooling holes being aligned with an associated one of said openings wherein said openings and said cooling holes are each configured to cool a surface when said sanding disk abrades the surface.

8. A rotary sanding system comprising:

a first disk being configured to be removably coupled to an air tool thereby facilitating the air tool to rotate said first disk, said first disk having a plurality of openings extending therethrough wherein said openings are configured to have air pass through said openings, said first disk having a bottom surface, a top surface and a peripheral edge extending between said top surface and said bottom surface, said top surface curving upwardly from said bottom surface to define a prominence on said first disk, said prominence being centrally positioned on said first disk, said prominence having a top end, said bottom surface having a well extending toward said top surface, said well having a lateral bounding surface and a bottom bounding surface, said lateral bounding surface being continuous such that said well has a circular shape, said well being centrally positioned on said bottom surface, each of said openings being positioned between said prominence and said peripheral edge, said openings being spaced apart from each other and distributed around said first disk;

a mating unit being coupled to said first disk wherein said mating unit is configured to engage the air tool thereby facilitating said first disk to be removably coupled to the air tool, said mating unit comprising:

a shaft having a lower end, said shaft extending through said prominence and said bottom surface, said shaft being centrally positioned on said first disk such that said lower end is positioned in said well, said shaft being configured to engage the air tool, a first washer being coupled around said shaft, said first washer abutting said top end of said prominence such that said shaft is inhibited from sliding downwardly in said first disk, a second washer being coupled around said shaft, said second washer abutting said bottom bounding surface of said well such that said shaft is inhibited from sliding upwardly in said first disk, and a lock having a first surface, a second surface and an outer edge extending between said first surface and said second surface, said outer edge being continuous such that said lock has a circular shape, said first surface being coupled to said lower end of said shaft having said second surface being aligned with said bottom surface of said first disk, said outer edge being coextensively spaced from said lateral bounding surface of said well, said outer edge having a plurality of cut away sections, each of said cut away sections extending inwardly toward a center of said lock, each of said cut away sections forming an associated one of a plurality of keyways with said lateral bounding surface, each of said keyways having a terminal end; and a sanding disk being removably coupled to said first disk wherein said sanding disk is configured to abrade a surface when the air tool rotates said first disk, said sanding disk having an upper surface and a lower surface, said sanding disk having a plurality of cooling holes extending through said upper surface and said lower surface, said sanding disk having a plurality of hooks, each of said hooks being coupled to and extending away from said upper surface, each of said hooks being insertable into an associated one of said keyways having each of said hooks engaging said lock such that said sanding disk is removably coupled to said first disk, said sanding disk being rotated such that each of said hooks engages said terminal end corresponding to said associated keyway such that said first disk rotates said sanding disk, each of said cooling holes being aligned with an associated one of said openings wherein said openings and said cooling holes are each configured to cool the surface when said sanding disk abrades the surface.

* * * * *